United States Patent [19]

Hardt et al.

[11] 4,352,408

[45] Oct. 5, 1982

[54] DEVICE FOR CONDUCTING AWAY THE EXHAUST GASES FROM INTERNAL COMBUSTION ENGINES

[75] Inventors: Jean Hardt, Benken; Jakob Widrig, Winterthur, both of Switzerland

[73] Assignee: Swiss Aluminium Ltd., Chippis, Switzerland

[21] Appl. No.: 155,458

[22] Filed: Jun. 2, 1980

[30] Foreign Application Priority Data

Jun. 6, 1979 [CH] Switzerland ..... 5250/79

[51] Int. Cl.[3] ..... F01N 1/02

[52] U.S. Cl. ..... 181/249

[58] Field of Search ..... 181/227, 243, 247–250, 181/252, 255–256, 282, 272; 285/382.2; 138/243

[56] References Cited

U.S. PATENT DOCUMENTS

| | | | |
|---|---|---|---|
| 1,682,316 | 8/1928 | Williams | 181/282 X |
| 1,889,795 | 12/1932 | Smith et al. | 285/382.2 |
| 1,972,065 | 8/1934 | Noblitt | 181/249 |
| 2,241,768 | 5/1941 | Deremer | 181/282 X |
| 3,263,772 | 8/1966 | Irwin et al. | 181/256 |
| 3,381,774 | 5/1968 | Stade et al. | 181/272 |
| 4,213,414 | 7/1980 | Sato et al. | 181/282 X |

OTHER PUBLICATIONS

Fermoyle, "Aluminum Muffler on its way?", Jan. 1960, *Popular Science*, vol. 176, No. 1, p. 62.

*Primary Examiner*—L. T. Hix
*Assistant Examiner*—Thomas H. Tarcza
*Attorney, Agent, or Firm*—Bachman and LaPointe

[57] ABSTRACT

A device for conducting away exhaust gases from internal combustion engines comprises at least one sleeve-shaped silencer which encloses an exhaust pipe and forms an enclosed space around said exhaust pipe. The silencer is made up of at least two sleeve-shaped parts, or of a sleeve-shaped part and base part, which are joined together. The portion of the exhaust pipe in the space inside the silencer features perforations and/or sound absorbing elements. The inside of the silencer may be fitted with sound absorbers. The sleeve-shaped parts of the silencer and if desired, the exhaust pipe and/or the sound absorbers are made of aluminum and/or an aluminum alloy. The sleeve-shaped parts of the silencer are manufactured by impact extrusion, deep drawing or a similar method and all joined together preferably radial to their longitudinal axis. The ends these parts taper down to tube-shaped extensions which fit over the exhaust pipe. To join the sleeve-shaped parts and the tube-shaped extensions to the exhaust pipe a region is provided on which an interlocking profile is created by electromagnetic forces.

1 Claim, 2 Drawing Figures

DEVICE FOR CONDUCTING AWAY THE EXHAUST GASES FROM INTERNAL COMBUSTION ENGINES

BACKGROUND OF THE INVENTION

The present invention relates to a device for conducting away the exhaust gases from internal combustion engines comprising at least one sleeve-shaped silencer which surrounds an exhaust pipe and forms an enclosed space around said pipe. The silencer is made up of at least two parts which are joined together. That part of the exhaust pipe inside the silencer may be provided with perforations and, if desired, be fitted with sound absorbing elements.

Exhaust systems are well known for most kinds of internal combustion engines and are available on the market in many various forms and designs.

In general known systems are made of steel, steel sheet or chrome-steel, and in some cases are provided with a corrosion protective surface coating.

In spite of the corrosion coating protection the service life of known exhaust systems is inadequate as the steel used in the manufacture is susceptible to corrosion. Also, the weight of known units is high which leads to fatigue failure problems. Furthermore, the assembly of these exhaust systems generally involves welding and the weld seams are particularly susceptible to cracking and fracture. As a rule, it is the welded joint between the silencer and the exhaust pipe which is affected most as the fluctuating stress is greatest in that location.

Improving the steel to help overcome these problems by changing the composition or by coating the part raises manufacturing costs considerably and while the benefits are only slightly increased.

It is therefore the principal object of the present invention to develop a device of the kind mentioned above which is easy and economical to produce, is light in weight, has a low susceptibility to corrosion and reduces the number of vulnerable weld seams.

SUMMARY OF THE INVENTION

The foregoing object is achieved by way of the present invention wherein the sleeve part of the silencer and, if desired, the exhaust pipe and/or the sound absorbers are made of aluminum and/or an aluminum alloy.

An advantage of this solution is that, due to the high corrosion resistance of aluminum, the service life of the device is considerably improved. Also, the lower mass of aluminum, as compared with the material used up to now, considerably reduces problems arising from fluctuating stresses.

Furthermore, aluminum and its alloys are readily formable which makes economic manufacture possible. The exhaust pipe is made preferably by extrusion, the sound absorbers by cold impact extrusion or deep drawing, or by some other similar method.

It is, however, also within the scope of the present invention to make the exhaust pipe and/or sound absorbers out of steel or chrome-steel, if desired, specially coated and to use aluminum only for the production of the sleeve-shaped parts of the silencer.

The sleeve-shaped parts are made preferably out of impact extruded hollow bodies which are cylindrical or elliptic in shape. Shaping processes such as deep drawing or a combination of deep drawing and ironing methods can be employed.

The sleeve-shaped parts are joined together by virtue of their interlocking shapes and/or under the action of applied forces. Usefully, this joining takes place radial to the long axis of these parts so that the length of weld seam is a minimum so that fluctuating stresses can be withstood better.

Usefully, a seamless taper which can be made by impacting or deep drawing is provided at the ends of the sleeve-shaped parts. At one end of each tapered part a tube-shaped extension is provided, again without having a weld seam between the parts in question. This tubular extension fits over the exhaust pipe. The numerous, usually welded, joints between silencer and exhaust pipe in the known exhaust systems are therefore avoided and, at the same time, the strength of the joint is improved.

To join the sleeve-shaped parts there is preferably a region in which one sleeve-shaped part has a radially displaced edge on a ring-shaped shoulder, which rests on the outside or inside of the edge region of the other sleeve-shaped part. As such the shoulder serves as a stop for the other part which is slid up to that point.

Instead of the two sleeve-shaped parts mentioned above, only one such part and a base part can be used. The parts can be made and joined as described above.

The so-called magneform process has been found to be particularly useful for joining both sleeve-shaped parts together, the sleeve-shaped parts or silencer to the exhaust pipe, and/or the sound absorbers to the exhaust pipe or the sleeve-shaped parts. In this process electrical energy is stored in a capacitor type device which is used along with an appropriate tool which can generate a magnetic field with magnetic forces of up to 50,000 PSI for ca. 10–20 micro seconds and deform electrically conductive metal.

The shaping and consequently joining of both sleeve-shaped parts by the magneform process takes place either by placing a tool with the desired profile on the inner face of the silencer or by shaping the sleeve-shaped part which is inserted inside. In both cases the desired profile is given to the non-profiled part or parts by applying the magneform tool.

It is, however, also possible to glue or weld the sleeve-shaped parts or to join them by flanging or by forming a groove and spring-shaped profile.

The use of the magneform process also allows easy and good connection between the silencer and exhaust pipe whereby, if desired, an adhesive can be introduced between the parts to achieve an air-tight seal.

BRIEF DESCRIPTION OF THE DRAWINGS

Further advantages, features and details of the present invention are revealed in the following description of preferred exemplified embodiments and with the help of the drawings wherein.

DETAILED DESCRIPTION

Figure 1:
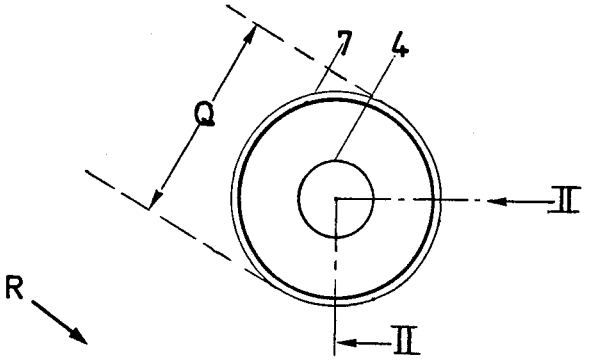
FIG. 1: Is a cross section through a part of an exhaust system, along line I—I as shown in FIG. 2.
Figure 2:
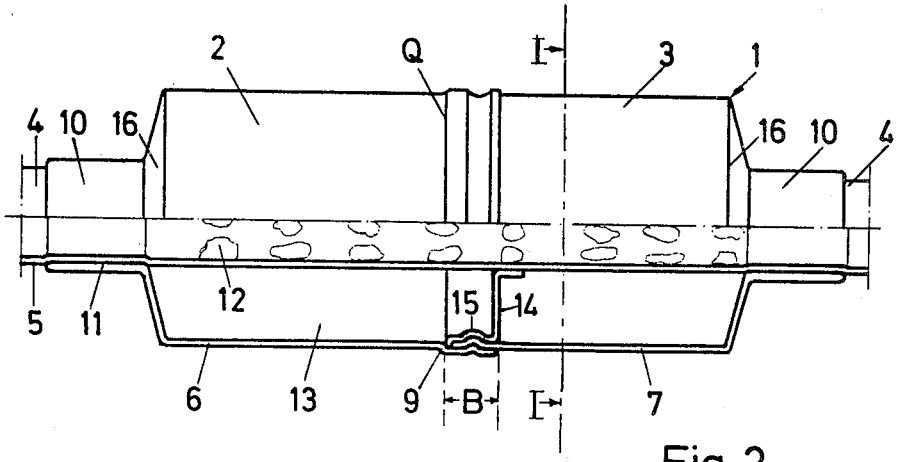
FIG. 2: Is a front view of a silencer partly sectioned along line II—II as in FIG. 1.

A silencer R as shown in FIG. 2 comprises a sleeve 1 which fits over a tube 4 and which is made up of a sleeve-shaped part 2 with wall 6 and a sleeve-shaped part 3 with wall 7.

The sleeve-shaped parts 2,3 can have a cylindrical or oval cross section Q, the wall 6 of part 2 having a shoulder-like change in section 9 which increases the cross section Q of the opening in part 2 around the whole opening at one end by a distance approximately equal to the wall thickness of the part, thus forming an interlocking zone B into which the sleeve-shaped part 3 is pushed.

At the ends remote from the region B of parts 2 and 3 the cross section Q becomes smaller due to the tapering extensions 16 which continue further as tube-shaped parts 10 on the inner wall 11 of which a part of the wall 5 of tube 4 lies.

To join both parts 2 and 3 by, for example, a magneform process, a tool 14 preferably made of steel is laid against the inner wall 11 of part 3. In region B the tool 14 is profiled to a shape 15 which the walls 6 and 7 of parts 2 and 3 respectively take on in that region B.

Figure 3:
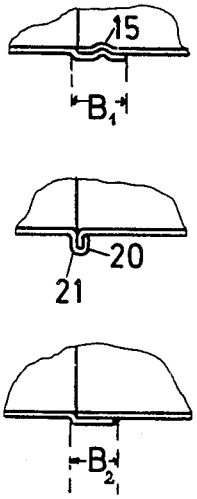
FIG. 3: Is a section of part of the silencer in FIG. 2 shown here in four different forms.

FIG. 3 shows three possibilities for joining parts 2 and 3.

In region $B_1$ the wall 7 of part 3 is pre-shaped while the wall 6 of part 2 has the same shape or is made take on this shape by means of magneforming.

In a further exemplified embodiment the two parts 2 and 3 are joined in region $B_2$ by welding or gluing.

The connection can also be made by placing the ends over each other and gluing or by flanging over the edges of both parts 2 and 3, or by engaging a bent rim 20 of part 3 in a groove 21 formed in part 2.

Inside the space 13 enclosed by both sleeve-shaped parts tube 4 features openings or perforations 12. On the tube 4 and on the walls 6,7 in the space 13 there are sound absorbing elements which are not shown here and which can for example be of the conventional type. Other, known sound absorbing systems can also be employed here.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. An aluminum exhaust system for conducting away exhaust gases from an internal combustion engine comprising an exhaust pipe, a sleeve-shaped silencer enclosing a portion of said exhaust pipe and forming a chamber around said exhaust pipe wherein said portion of said exhaust pipe enclosed by said silencer is provided with perforations, said silencer having two sleeve-shaped parts joined together, said sleeve-shaped parts being provided on one end thereof with collars for fitting said sleeve-shaped parts on said exhaust pipe and on the other end thereof with locking means for joining said sleeve-shaped parts together, said locking means comprises a profiled shape extending around the circumference of said sleeve-shaped parts wherein the profiled shape on one of said two sleeve-shaped parts is telescopically received in the profiled shape on the other of said two sleeve-shaped parts such that said sleeve-shaped parts are joined together radially to their longitudinal axis.

* * * * *